US005351960A

United States Patent [19]

Knapp

[11] Patent Number: 5,351,960

[45] Date of Patent: Oct. 4, 1994

[54] PUTT PRACTICING DEVICE

[76] Inventor: Robert J. Knapp, 39 Yacht Club Pl., Tequesta, Fla. 33469

[21] Appl. No.: 161,149

[22] Filed: Dec. 2, 1993

[51] Int. Cl.[5] ..... A63B 69/36

[52] U.S. Cl. ..... 273/177 B

[58] Field of Search ..... 273/177 R, 177 A, 177 B, 273/184 R, 184 A, 179 R

[56] References Cited

U.S. PATENT DOCUMENTS 3,065,971 11/1962 Coles ..... 273/177 B
3,171,657 3/1965 Strang ..... 273/177 B
3,313,544 4/1967 Davis ..... 273/177 A

*Primary Examiner*—George J. Marlo
*Attorney, Agent, or Firm*—Jack N. McCarthy

[57] ABSTRACT

A putt practicing device having a body with an elongated shaped, a forwardly facing surface, a flat bottom surface for being placed on a flat putting surface, a flat surface on the top, elements for stretching either one strip of rubber, or two vertically aligned strips of rubber, just above the flat surface on the top of said elongated shaped body to place said stretched strips of rubber forwardly of the center portion of the forwardly facing surface and form a target area so that a golf ball striking the target area will be deflected away therefrom.

10 Claims, 2 Drawing Sheets

PUTT PRACTICING DEVICE

DESCRIPTION

1. Technical Field

This invention relates to golf instruction devices and more specifically to an aiming device for stroking a golf ball on a putting green.

2. Background Art

The following patent relates to a golf putting device: U.S. Pat No. 3,065,971.

DISCLOSURE OF INVENTION

An object of this invention is to provide a golf putting device which is inexpensive and which can be used on many surfaces. Velcro strips on the bottom of the device can hold It in place on a carpet or similar material. A heavy object, such as a brick, can be placed on the top surface to hold it down on concrete or vinyl. On dirt or grass, a pin or nail can be placed through openings at either end of the putting device to hold it in place.

An object of this invention Is to provide a golf putting device which will give an indication of the direction in which the golf ball is being putted.

It is another object of the invention to provide for a wide width of target area so that as a ball strikes on either side of center, the direction of the ball will indicate which side of center was hit by the golf ball. A center aim will send the ball back directly to the golfer.

It is another object of the invention to provide for different widths of target area so that one can putt into a large return area or a smaller area when one's skills have improved.

Another object of the invention is to provide an adjustable modification which can change the width of the target areas so that as a golfer becomes proficient, the target area of the rubber band can be made smaller and the rubber band on each outside of a movable arm will direct the ball away from the golf putting device indicating, as before, which side of the target area was struck. This will also keep the golf balls out of the way for later shots.

BEST MODE FOR CARRYING OUT THE INVENTION

Figure 1:
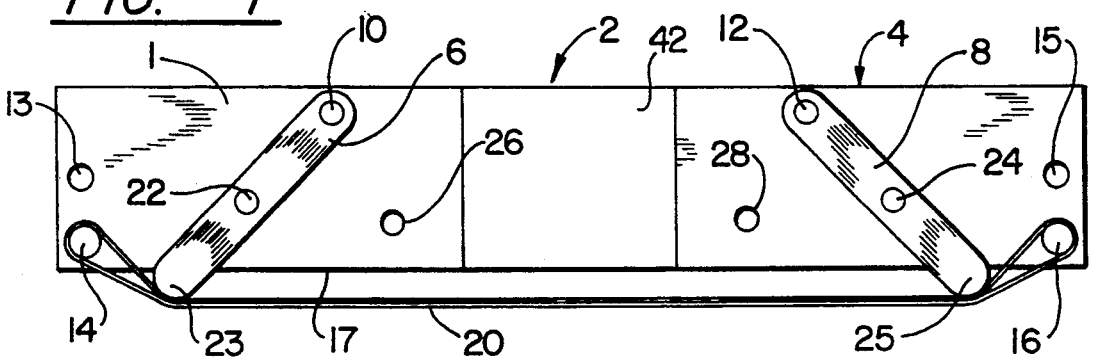
FIG. 1 is a top view of a putt practicing device showing adjustable arms in their outer position, providing a large target area on a stretched rubber band for a golf ball.
Figure 2:
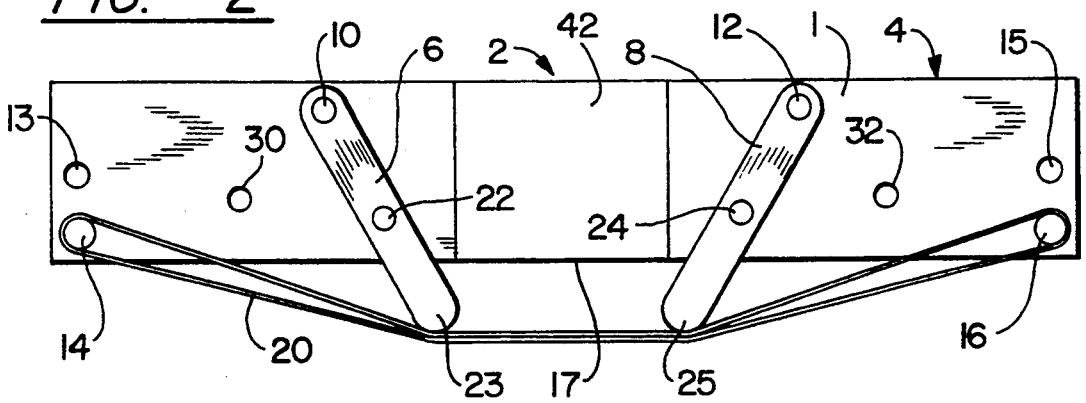
FIG. 2 is a top view of a putt practicing device showing the adjustable arms in their inner position, providing a small target area on a stretched rubber band for a golf ball.

As set forth in FIG. 1, a putt practicing device 2, having a flat top surface 1, a flat bottom surface, and a forwardly facing narrow surface 17, is shown having a rectangular base member 4 with two arms 6 and 8 pivotally mounted on the flat top surface 1. Arms 6 and 8 are pivoted, one at each end of base member 4, around fixed bolts, or pins, 10 and 12, respectively, for adjustment between a first position as shown in FIG. 1 and a second position as shown in FIG. 2. To fix the arms 6 and 8 in either of its two positions, bolt members 22 and 24 are positionable in threaded inserts 26 and 28, respectively, or 30 and 32, respectively. When the bolts 22 and 24 are threaded in inserts 30 and 32, the arms 6 and 8 are at their wide position and when the bolts 22 and 24 are threaded in inserts 26 and 28, the arms 6 and 8 are at their narrow position. Two upwardly projecting holding members 14 and 16 extend from opposite ends of the forward part of the base member 4 to receive and hold a stretched rubber band 20 against which the free ends 23 and 25 of the arms 6 and 8 act. The width of the forwardly facing narrow surface 17 and stretched rubber band 20 are sized to have the center of a golf ball hit the center of the stretched rubber band 20 in practice. The width of the forwardly facing narrow surface 17 and the stretched rubber band 20 can be approximately the same width.

It can be seen that as the arms 6 and 8 are moved between their positions in FIG. 1 and FIG. 2, the target area on the rubber band 20 between the free ends 23 and 25 of the arms 6 and 8 varies from a wide length for beginners to a narrower length for those who are more expert. It can be seen that as the golf ball hits the rubber band, it will be returned to the golfer if it hits between the ends of the arms 6 and 8. If the golf ball strikes outside of the ends of the arms 6 and 8, it will leave the device at an angle to either side of the device.

This putt practicing device 2 can be used on any flat surface. Velcro strips 11 can be placed on the flat bottom surface to hold the putt practicing device 2 in place on a carpet or similar material. If the putt practicing device 2 is to be used on a solid surface, such as concrete or vinyl, a weight can be placed on the top surface to maintain it in place. If the device is to be used on a dirt or grass surface, a pin or nail can be placed through openings 13 and 15 at opposite ends of the rectangular base member 4.

Figure 3:
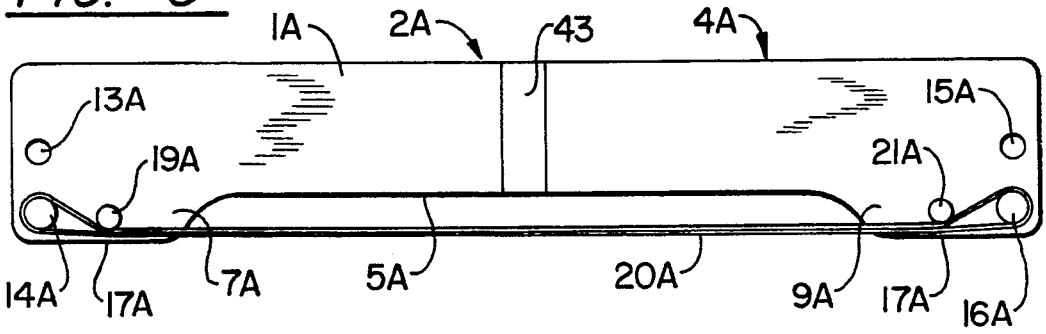
FIG. 3 is a top view of a modified putt practicing device showing a fixed large target area on a stretched rubber band for a golf ball.
Figure 4:
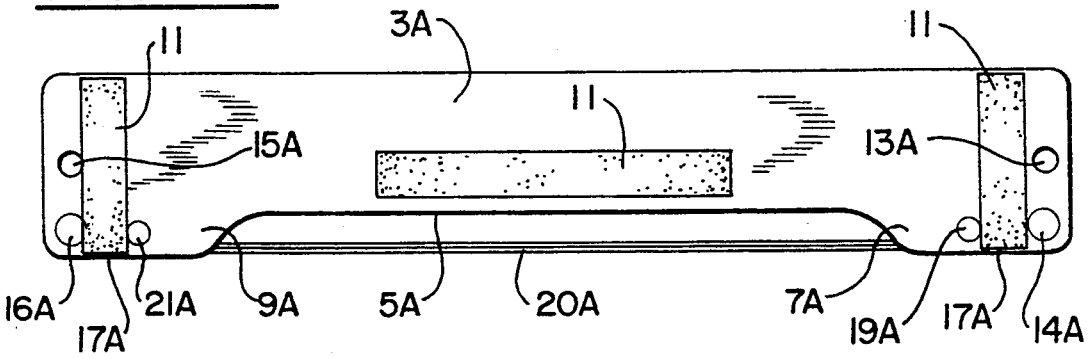
FIG. 4 is a bottom view of the modified putt practicing device shown in FIG. 3 having strips of velcro fixed thereto for adhering to a rug or similar material.
Figure 5:
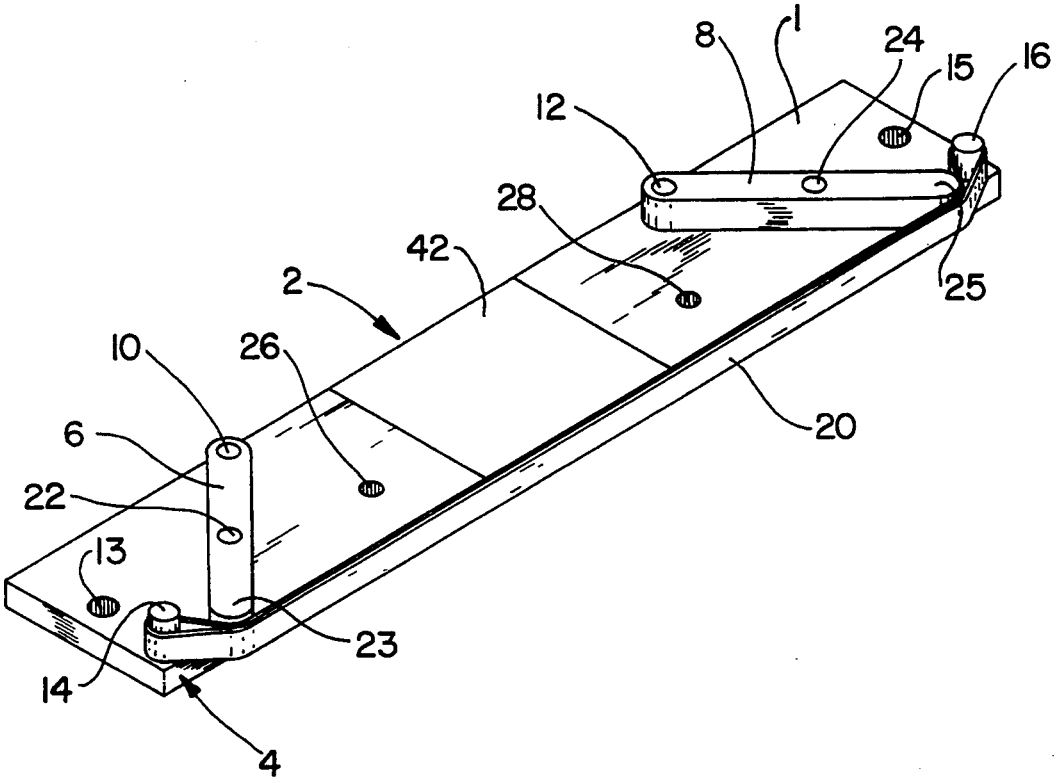
FIG. 5 is a perspective view of FIG. 1.

A modification of the putt practicing device 2 is shown in FIGS. 3 and 4 where the front edge 17A of the rectangular base member 4A has a recess 5A placed therein, forming forwardly projecting ends 7A and 9A. Two upwardly projecting holding members 14A and 16A extend upwardly from opposite ends 7A and 9A of the forward part of the base member 4A to receive and hold a stretched rubber band 20A. Two other projecting rods 19A and 21A are placed inwardly from holding members 14A and 16A, respectively, to place both stretched rubber band adjacent surfaces of rubber band 20A against each other, and spaced a desired distance from the surface 5A. Holes 13A and 15A are provided on base member 4A to receive pins or nails to fix the putt practicing device 2 in place. A single strip of rubber can be fixed between two holding members 14 and 16, or 14A and 16A, if desired, as by a clip.

An aiming stripe 43 is placed on the top of the base member 4A to provide a point of reference for the golfer. If desired, a wider stripe 42, as shown in FIGS. 1 and 2, can be used to represent a hole on a putting green. This stripe 42, or 43, may be made of any color desired. A plain black stripe 42 has been used. Further, it is noted that a plurality of stretched rubber bands 20 can be used.

One device 2 was made, as shown in FIGS. 3 and 4, with two rubber strips 20, one over the other. The top stretched rubber strip 20 is positioned to be contacted by a putted golf ball above the mid-point of the golf ball, after the golf ball has contacted the lower stretched rubber strip. This arrangement is to reduce the possibility of a golf ball going over the two rubber strips 20 by a hard hit putt.

While the principles of the invention have now been made clear in an illustrative embodiment, it will become obvious to those skilled in the art that many modifications in arrangement are possible without departing from those principles. The appended claims are, therefore, intended to cover and embrace any such modifications, within the limits of the true spirit and scope of the invention.

I claim:

1. A putt practicing device having a body with an elongated shape, said elongated shape having a forwardly facing surface, said body having a flat bottom surface for being placed on a flat putting surface, said body having a flat surface on the top, means stretching a strip of rubber just above the flat surface on the top of said elongated shaped body, means placing said stretched strip of rubber forwardly of the center portion of the forwardly facing surface forming a target area so that a golf ball striking the target area will be deflected away therefrom.

2. A putt practicing device as set forth in claim 1 wherein said means stretching a strip of rubber comprises means stretching a rubber band just above the flat surface on the top of said elongated shaped body providing a stretched strip of rubber.

3. A putt practicing device as set forth in claim 1 having two arms located on the flat surface on the top of said body, one arm being located at one end of the body, the other arm being located at the other end of the body, said arms each projecting forwardly over the forwardly facing surface with their ends pushing the stretched length of the rubber strip forwardly of the center portion of the forwardly facing surface.

4. A putt practicing device as set forth in claim 2 wherein each of said two arms can be fixed in two positions, one position providing a large target area, and the other position providing a smaller target area.

5. A putt practicing device as set forth in claim 2 wherein each of said two arms is pivotally mounted on the flat surface on the top of said body, each of said arms having means for fixing it in a plurality of positions providing a plurality of different length target areas.

6. A putt practicing device as set forth in claim 1 wherein the stretched strip of rubber is positioned so that the center of said strip of rubber is above the flat bottom surface a distance approximately equal to the radius of a golf ball,

7. A putt practicing device as set forth in claim 6 wherein the height of said stretched strip of rubber and the height of the forwardly facing surface of said body are substantially equal to each other.

8. A putt practicing device as set forth in claim 1 wherein a short post extends upwardly at each end of the flat surface on the top of said body, a rubber band placed around said two posts providing a stretched strip of rubber.

9. A putt practicing device having a body with an elongated shape, said elongated shape having a forwardly facing surface, said body having a flat bottom surface for being placed on a flat putting surface, said body having a flat surface on the top, means stretching a first strip of rubber just above the flat surface on the top of said elongated shaped body, means stretching a second strip of rubber above said first strip of rubber, said strips of rubber being aligned, means placing said first and second stretched strips of rubber forwardly of the center portion of the forwardly facing surface forming a resilient target area so that a golf bail striking the resilient target area will be deflected away therefrom.

10. A putt practicing device as set forth in claim 9 wherein said first and second stretched strips of rubber are placed so that a putted golf ball will contact the second stretched strip of rubber after contacting the first stretched strip of rubber, said second stretched strip of rubber being contacted by a putted golf bail above the mid-point of the golf ball.

* * * * *